United States Patent [19]

Donohue

[11] 4,118,543

[45] Oct. 3, 1978

[54] REFLECTANT FOIL INSULATED STEEL DOORS

[75] Inventor: Henry Patrick Donohue, Fairview, Pa.

[73] Assignee: Fenestra, Erie, Pa.

[21] Appl. No.: 742,088

[22] Filed: Nov. 16, 1976

[51] Int. Cl.[2] ..... E04C 2/34

[52] U.S. Cl. ..... 428/615; 29/455 LM; 52/807

[58] Field of Search ..... 52/455, 408, 615, 474, 52/619, 404, 405, 410, 411, 412; 29/455 LM, 455 R; 428/615, 653, 924

[56] References Cited

U.S. PATENT DOCUMENTS

| | | | |
|---|---|---|---|
| 1,793,382 | 2/1931 | Woehler | 52/615 |
| 1,962,868 | 6/1934 | Gregg | 52/615 |
| 2,233,711 | 3/1941 | Pasquier | 52/615 |
| 2,299,776 | 10/1942 | Weightman | 29/455 LM |
| 2,333,600 | 11/1943 | Trautvetter | 52/615 |
| 2,717,062 | 9/1955 | Dusing | 52/619 |
| 2,757,116 | 8/1956 | Clements | 52/404 |
| 2,926,761 | 3/1960 | Herbert | 29/455 LM |
| 3,030,703 | 4/1962 | Wirsing | 29/455 LM |
| 3,091,846 | 6/1963 | Henry | 29/455 LM |

*Primary Examiner*—John E. Murtagh
*Attorney, Agent, or Firm*—Charles L. Lovercheck

[57] ABSTRACT

A door made up of a grid frame, two sheets of metallic foil and two face skins. The grid frame is made up of laterally and longitudinally extending members. A sheet of foil is supported on each side of the grid frame under the face skins. The door has provision for hinges and a lock.

2 Claims, 2 Drawing Figures

REFLECTANT FOIL INSULATED STEEL DOORS

STATEMENT OF INVENTION

This invention relates to a unique method of making an all-steel door specifically resistant to radiant heat transfer. It has long been suspected that the surface faces of a steel door would control heat loss because of the all-steel welded structure. Applicant has discovered that a thin aluminum foil placed between the inner grid and the inside of the door skin face creates an insulation effect which would not be anticipated by normal heat transfer calculations. The effective "U" factor of 0.40 for this door exceeds other combinations of low or high density fiberglass insulation. It also protects the unique door construction which is noncombustible and is incapable of producing toxic fumes.

OBJECTS OF THE INVENTION

It is an object of the invention to provide an improved insulation structure in an all-steel door.

Another object of the invention is to provide a structure that is resistant to radiant heat transfer.

Another object of the invention is to provide an all-metal insulated door that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size proportions and minor details of construction without departing from the spirit or sacrificing any of the advantages of the invention.

GENERAL DESCRIPTION OF THE DRAWINGS

DETAILED DESCRIPTION OF THE DRAWINGS

Figure 1:
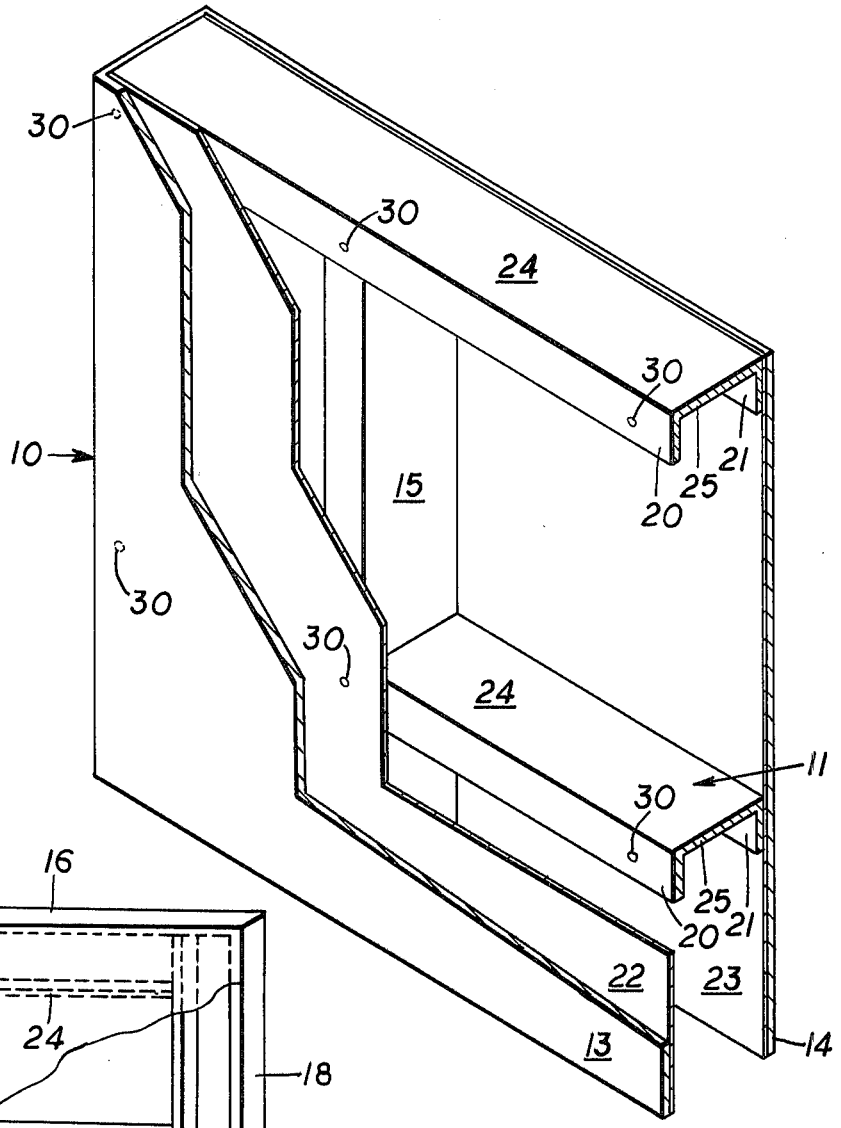
FIG. 1 is a partial isometric view partly in cross-section with certain parts broken away to show the construction of part of the door.
Figure 2:
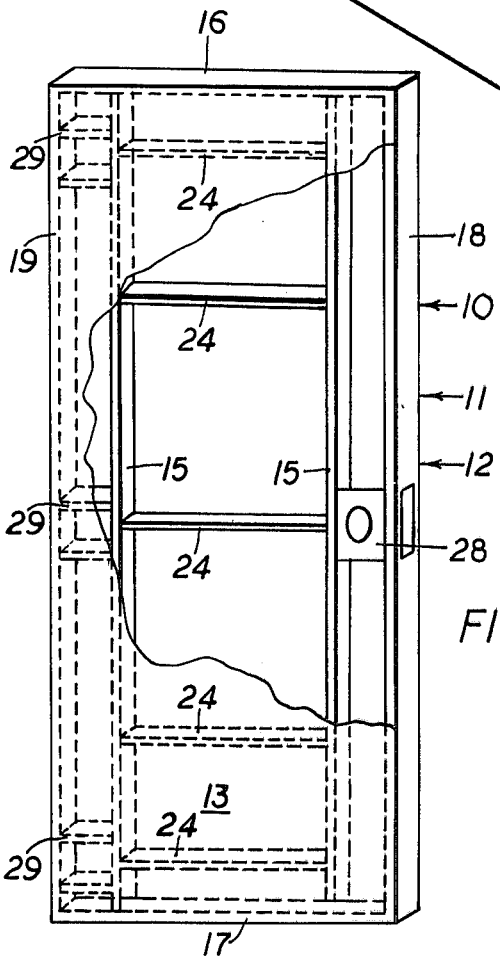
FIG. 2 is an isometric view with certain parts broken away to show the several parts of the door according to the invention.

Now, with more particular reference to the drawings, a door indicated generally at 10 as shown having a grid frame 11 made up of a unitized grid of vertical members 15 and horizontal members 24. The vertical members 15 and horizontal members 24 may be made up of 18 gauge steel channels with rigidized webbing and welded at each junction. The grid frame 11 has a peripheral frame 12 which is made up channel members including the top channel 16, the bottom channel 17, lock channel 18, and hinge channel 19 welded at the four corners of the door. The channels of the grid frame 11 have legs 20 and 21 and intermediate portions 25.

A sheet of metallic foil 22, such as aluminum foil, is supported over the legs 20 of the channels of the grid frame 11. A face skin 13 of a suitable thickness rests on the foil sheet and holds it rigidly against the legs 20 in a flat position.

In a like manner, a sheet of metallic foil 23 may be supported over the legs 21 of the channels of the grid frame 11. A face skin 14 of a suitable thickness rests on the foil sheet and holds it rigidly against the legs 21 of the grid frame 11 in a flat position.

The face skins 13 and 14 may be projection welded 30 to the inner structure 11 through the aluminum foil 22 and 23.

A lock reinforcement made of a suitable gauge steel is supported between the lock channel 18 and a vertical channel 15 and may be welded in place. Similarly, hinge reinforcements 29, also made of a suitable gauge steel may be supported between the hinge channel 19 and a vertical channel 15 and may be welded in place.

Construction distributes stresses throughout the structural system providing great strength and rigidity for the door. The aluminum foil provides a thermal barrier of reflective foil which is effective as an insulator and provides a simple, economical structure.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A door comprising, a frame, face skins and a metallic aluminum foil sheet having a melting point substantially lower than the melting point of steel, said frame comprising vertical members and horizontal members including a peripheral frame comprising a top member, a bottom member, a lock side member and a hinge side member, said face skins comprising generally flat sheets of suitable material thickness generally covering the said frame on each side, said metallic foil sheet being disposed between the said frame and one of said face skins, and weld means extending through said metallic foil welding said face skins to said frame.

2. A method of making a steel door providing a grid frame of steel grid frame members and laying a first sheet of metallic aluminum foil having reflective surfaces on said grid frame in substantially the same area as said door, placing a first steel face skin on said metallic foil member and projection welding said first steel face through said aluminum foil to one side of said steel grid frame and projection welding said second steel face skin to the other side of said grid frame, a second steel face and a second sheet of aluminum foil supported on said frame under said second face sheet, and said second steel face skin being projection welded to said steel grid frame through said second aluminum metallic foil.

* * * * *